US007100983B1

(12) United States Patent
Gant

(10) Patent No.: US 7,100,983 B1
(45) Date of Patent: Sep. 5, 2006

(54) LUMBAR FLEXING SEATING APPARATUS

(76) Inventor: Richard A. Gant, 1740 Alta Vista Way, San Diego, CA (US) 92109

( * ) Notice: Subject to any disclaimer, the term of this patent is extended or adjusted under 35 U.S.C. 154(b) by 81 days.

(21) Appl. No.: 11/008,471

(22) Filed: Dec. 9, 2004

(51) Int. Cl.
*A47C 3/24* (2006.01)

(52) U.S. Cl. ..... 297/314; 108/2; 248/656; 297/326; 297/344.12

(58) Field of Classification Search ..... 297/312–314, 297/326, 344.12, 344.18; 108/2, 6, 8; 248/288.31, 248/596, 598, 601, 656
See application file for complete search history.

(56) References Cited

U.S. PATENT DOCUMENTS 478,166 A * 7/1892 Madsen ..... 482/146
584,637 A * 6/1897 Jarvis ..... 297/202
612,580 A * 10/1898 Banes ..... 108/2
638,223 A * 12/1899 Even ..... 248/425
929,272 A * 7/1909 Baron ..... 248/583
1,194,551 A * 8/1916 Schossler ..... 108/2
1,429,979 A * 9/1922 Spanenberg ..... 297/314
2,132,291 A * 10/1938 Fitos ..... 297/314
2,719,571 A * 10/1955 Taylor ..... 297/314

* cited by examiner

*Primary Examiner*—Peter R. Brown
(74) *Attorney, Agent, or Firm*—Thomas J. Tighe, Esq.

(57) ABSTRACT

A buttocks seat is supported by a post tiltably affixed at a lower end to an upper face of a base. The post is also axially rotatable relative to the base, and threadably engaged with an underside of the seat for supporting the seat on the post, the seat squarely facing upright when the post is vertical. A hand wheel is affixed to the post for rotating the post relative to the seat and the base for selectively raising or lowering the seat relative to the base. A resilient bias urges the post to be vertical unless a seated user flexes his or her lumbar with sufficient force to overcome the bias. Preferably the post is tiltable over a conical range and the bias comprises a resiliently compressible, cylindrical ring coaxial with the post, and extending between and abutting the base and the underside of the seat.

9 Claims, 2 Drawing Sheets

LUMBAR FLEXING SEATING APPARATUS

BACKGROUND OF THE INVENTION

This invention relates in general to the field of resilient, tiltable, seating apparatuses, and more particularly to a resilient, tiltable, seating apparatus for incorporation in a chair, the apparatus promotes and assists vertebrae flexing and muscle exercise in the lumbar region of a user's spine.

The thoracic portion of the human spinal column is protected and strengthened by the rib cage and the large dorsal and pectoral muscles. Unfortunately, the lumbar region is not as ruggedly supported, having for support only the abdominal muscles, and small, short muscles which connect and interconnect the spinous and transverse processes of the lumbar vertebrae and the sacral vertebra. For convenience, this myriad of small interconnecting muscles are hereafter referred to as the "lumbar cage." It appears that the lumbar cage evolved over the millennia. During this time humans generally had a short life span, spending long hours each day engaged in physical activity. But the structure of the lumbar cage is not well suited for the longer life span of modern humans, whose lifestyle is much more sedentary, even requiring relative inactivity during long periods, both while at work and at home. This weaker region (lumbar) of the load-bearing muscular-skeletal structure of the human anatomy is the source of most lower back pain and is also a major factor in back pain associated with structural defects such as scoliosis, a lateral curvature of the spine, spinal stenosis or lumbar disc syndrome.

The strength of a muscle depends upon the amount of work it is required to perform over time. Since muscles can only contract, they are worked by causing them to contract or flex. To flex a bodily joint, certain muscles (flexor muscles) are contracted while opposing muscles (extensor muscles) are relaxed so they can be extended. To straighten the joint, the reverse happens: the extensor muscles contract and the flexor muscles relax. Extensor and flexor muscles of the lumbar cage provide the necessary movement of the lumbar vertebrae, allowing them to be extended and flexed to accommodate the body's activity. These, as well as other muscles in the lumbar cage, are worked by contraction and extension to cause movement of a part or parts of the body, allowing the body to change position and, even while the body is relatively inactive, to maintain position and balance.

Reduced activity, which may result from age, a sedentary job, illness, trauma, or simply a lack of sufficient motivation to exercise, limits the flexion and extension of the lumbar cage, causing these muscles to weaken and atrophy to the point that the load-bearing capacity of the lumbar region becomes more and more limited. The weakening process is progressive and cyclical. As atrophy sets in from reduced muscle activity, the lumbar cage weakens. Eventually, torque or overload beyond the tolerance level of the weakened lumbar cage will either tear the fibers in one of the lumbar cage's muscles or cause a vertebral disc to slip out of alignment. This results in back pain and, in severe cases, disabling spasms. The spasms are caused not by the damaged muscle, but rather by the surrounding muscles as an involuntary defense mechanism to prevent damage to the spinal column. The pain results in even less activity and, therefore, further atrophy of the lumbar cage.

To defend against any muscular pain the body involuntarily uses other muscles to produce the required body movement, a process called substitution. A body with lower back pain naturally adopts a posture and gait, such as splayed feet, a shuffling movement with no working of the hamstrings, which minimizes the movement of the vertebrae. With this reduced activity caused by substitution, the lumbar region becomes weaker, less flexible and vulnerable to further muscle strain and disc displacement. Generally, along with deterioration in the strength and flexibility of the lumbar cage caused by a less active lifestyle, posture is also negatively affected. Having a weakened lumbar cage tends to promote a bowed back and slumped shoulders when seated for long periods at a desk or in front of a computer.

Most people with lower back pain either cannot or will not exercise the lumbar cage adequately to produce the muscle strength necessary to eliminate the problem. Physical therapy for pain is, at best, for a limited time during the therapy session, and therefore is limited in effectiveness. This invention provides an easy, inexpensive and very convenient way for such people to exercise their lumbar cage whenever they are seated, at home or on the job. Its use enhances the tone of the lumbar cage. It enables a seated person to actively exercise the lumbar cage while promoting better posture.

Another major factor in maintaining an over all healthy lower back is avoiding idiopathic (degenerative disc) low back pain. Disc degeneration is irreversible structural alteration in the disc which can be caused by many factors, and results in the reduction in height, loss of hydrated flexibility, one of the forms of herniation, or spinal stenosis (a narrowing of the spinal annulus). Since the intervertebral discs are avascular, that is, they are without blood carrying capillaries, the pumping action from physical activity is the only means of promoting the exchange of fluids for improved nutrition of the cells, for cell replacement, and for removing metabolic by-products. Inactivity of the lumbar spine, caused by a sedentary life style or by the process of muscular substitution to prevent pain, can only accelerate the degenerative process within the discs. This invention produces the essential pumping action, repetitively and constantly during use, and amplifies and intensifies the pumping action so as to prevent, arrest, or decelerate the degenerative process.

Other advantages and attributes of this invention will be readily discernable upon a reading of the text hereinafter.

SUMMARY OF THE INVENTION

An object of this invention is to provide a seating apparatus with an adjustably tiltable lumbar cage flexor seat for supporting a seated person.

An additional object of this invention is to provide a seating apparatus with an adjustably tiltable lumbar cage flexor seat for supporting a seated person which can be an integral part of a chair.

An additional object of this invention is to provide an adjustably tiltable lumbar cage flexor seat for exercising a person's lumbar cage while seated.

An additional object of this invention is to provide a seating apparatus with a seat adjustably affixed to a pivotable post.

An additional object of this invention is to provide a seating apparatus with a post pivotably affixed in a socket which is affixed to a base.

An additional object of this invention is to provide a resilient bias opposing tilting of the seat.

An additional object of this invention is to provide a seating apparatus with a resilient elastomeric collar disposed concentrically around a pivotable post in a socket for opposing tilting of the seat.

An additional object of this invention is to provide a seating apparatus with a seat base which rests on a resilient elastomeric collar concentric with a pivotable post for opposing tilting of the seat.

An additional object of this invention is to provide a seating apparatus with a seat that is tiltable by a shift in the center of gravity of a seated person causing, more weight to bear on one side of a resilient elastomeric collar which compresses, allowing the seat to tilt.

An additional object of this invention is to provide a seating apparatus with a seat base which is vertically adjustable on a pivotable post, the higher the seat is adjusted, the more the seat can tilt on a resilient elastomeric collar, the lower the seat is adjusted, the less the seat can tilt on the collar.

An additional object of this invention is to provide a seating apparatus with an adjustment knob for adjusting the height of the seat base on the pivotable post.

An additional object of this invention is to provide a seating apparatus which has two degrees of selective tilting, pitch and roll.

An additional object of this invention is to provide a seating apparatus which has stops disposed on a base platform to limit the degree of tilting of the seat.

A further object of this invention is to provide an adjustable tiltable lumbar cage flexor seat for improvement of a seated person's posture.

These objects, and other objects expressed or implied in this document, are accomplished by a lumbar flexing, buttocks seating apparatus comprising: (1) a buttocks seat; (2) a base; (3) a threaded post tiltably affixed at one end to an upper face of the base, the post being axially rotatable relative to the base, the post being threadably engaged with an underside of the seat for supporting the seat on the post, the seat squarely facing upright when the post is vertical; (4) a hand wheel affixed to the post for rotating the post relative to the seat and the base for selectively raising or lowering the seat relative to the base; and (5) a resilient bias for urging the post to be vertical unless a seated user flexes his or her lumbar with sufficient force to overcome the bias. Preferably the post is axially rotatable and tiltable over a conical range, and the bias comprises a resiliently compressible, cylindrical ring coaxial with the post, and extending between and abutting the base and the underside of the seat. Preferably the apparatus includes: (1) a block affixed to an upper face of the base; (2) a ball socket defined by the block, the socket being open to a top of the block; and (3) a ball disposed in and confined to the socket, the threaded post projecting from the ball outwardly through the socket opening.

DESCRIPTION OF THE PREFERRED EMBODIMENT

Figure 2:
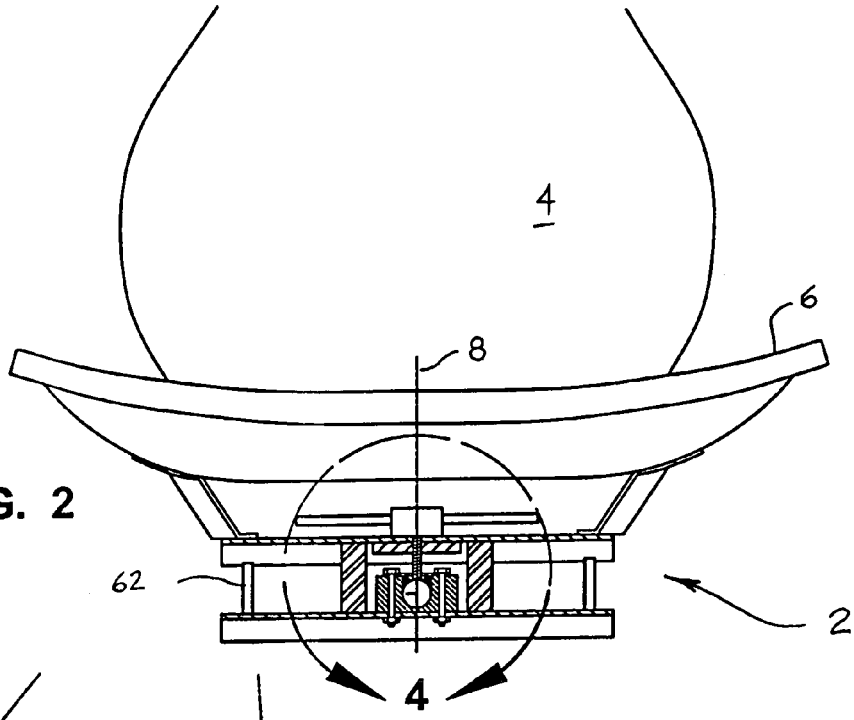
FIG. 2 is a rear cross-sectional view of a person seated on the illustrated embodiment of this invention, the cross-section being taken along a lateral median line not shown.
Figure 3:
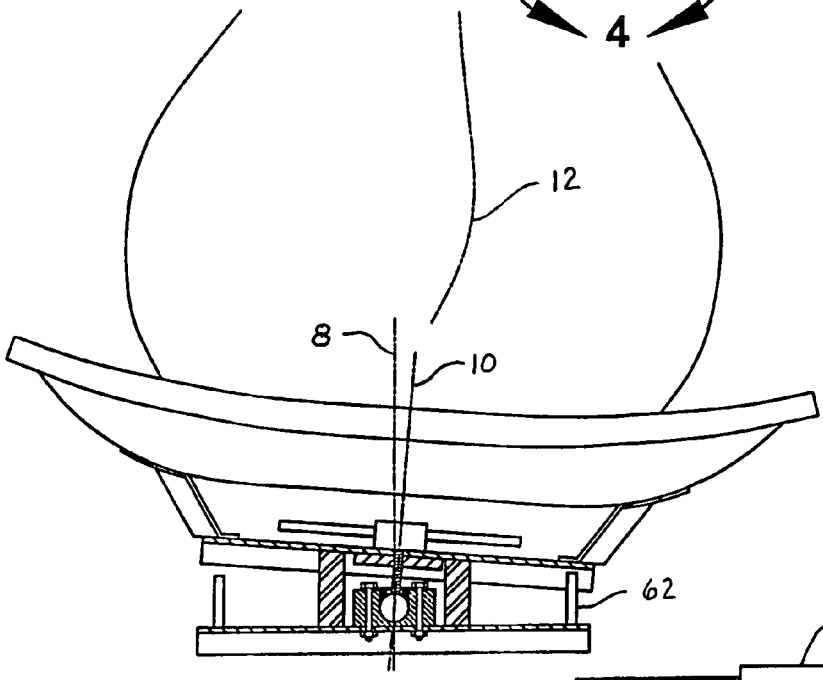
FIG. 3 is another rear cross-sectional view of a person seated on the illustrated embodiment of this invention, the cross-section being taken as in FIG. 2, this figure illustrating the effect of a shift in the person's weight to the right.

Referring to FIGS. 2 and 3, the lumbar flexing seating apparatus of the invention is generally designated 2 and is shown from the rear with a person 4 seated on, and supported by, a buttocks seat 6. With good posture and when seated upright the person's center of gravity (not shown) would be generally in line with the vertical axis 8 of the seating apparatus 2. As used herein, the terms "vertical," "horizontal," "upper," "lower," "top," "bottom" and "base" are directional references arbitrarily selected for clarity of understanding, and as used herein "vertical" refers to its normal usage as a line, or one parallel thereto, extending through the center of the earth and "horizontal" referring to its normal usage as a line perpendicular to a vertical line. The terms "upper" and "top" refer to the direction or side of the seating apparatus on which a person would normally sit, and "lower," "bottom" and "base" refer to the direction or side of the apparatus which faces the supporting structure upon which it rests. As will be explained later in more detail, when the weight of the person 4 is shifted to one side (FIG. 3) the buttocks seat 6 will tilt in the same direction as the shift in weight of the person. In its tilted position the seat's normal axis 10 will be angularly offset from the vertical axis 8. As a result of the shift in weight and the tilted seat, the person's spine 12 will bend slightly, causing a flexing of the lumbar section, as the person's upper body (above the hips) is adjusted with respect the person's hips to maintain an upright upper body. If the person shifts weight to the opposite side the seat will be tilted in that direction, resulting in the person's spine being slightly bent in the opposite direction. Likewise, a shift in the position of the seated person moves the person's center of gravity which causes the seat to tilt. Also, the person's hips can be pivoted with respect to the spine to apply a downward force on one side of the seat which causes the seat to tilt in that direction. The flexing of the lumbar section of the spine as a result of the tilting of the seat stretches, exercises, and tones the muscles in the lumbar section.

Figure 1:
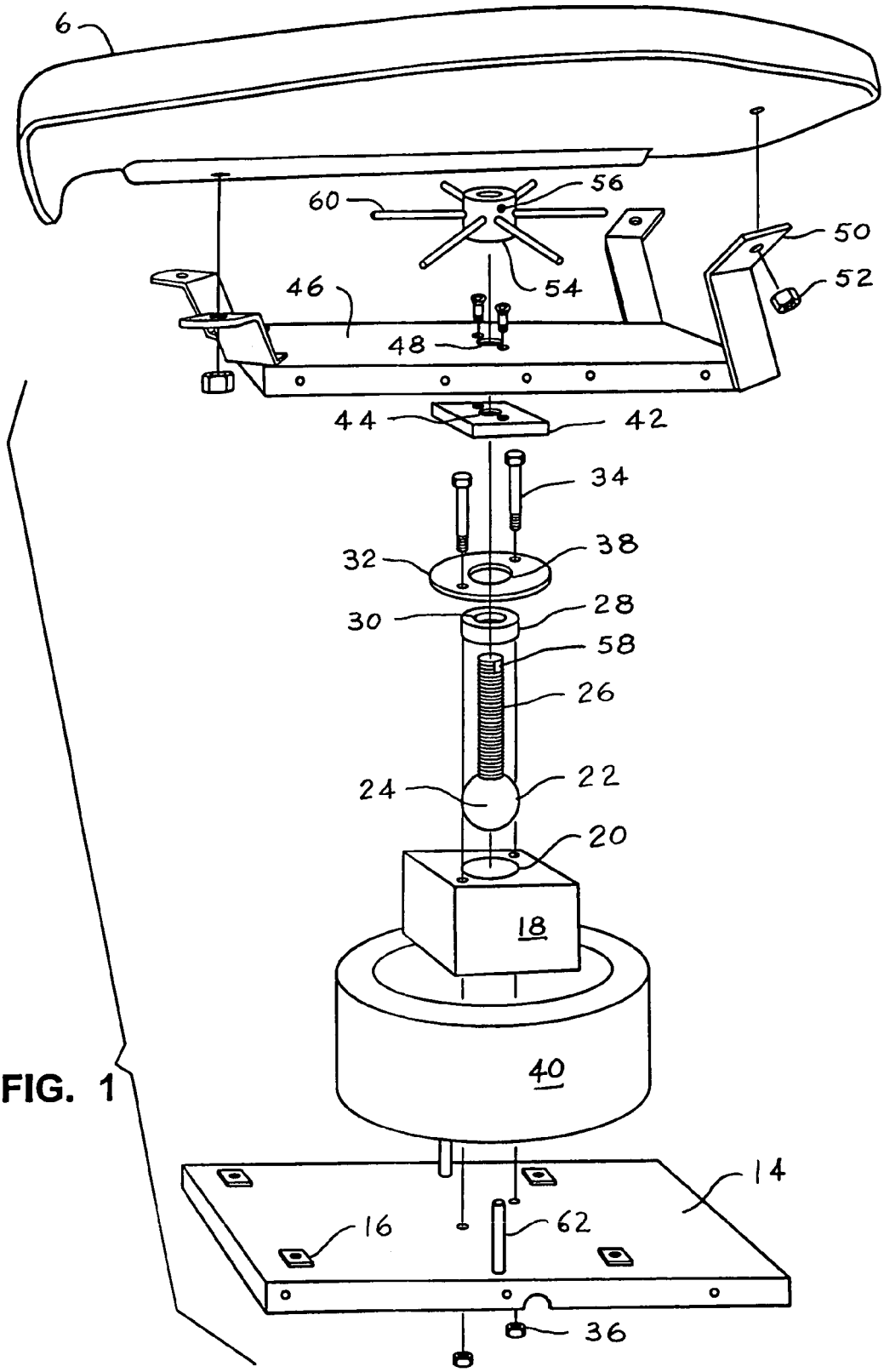
FIG. 1 is an exploded pictorial view of the invention.

Referring to FIG. 1, the seating apparatus 2 (FIG. 2) is shown in an exploded view for clarity. A rigid base 14 is preferably configured to affix it to the supporting structure of a chair, e.g. legs or central column as in secretarial chairs. The base preferably has nut plates 16 affixed to it, preferably by welding, for being engaged by fasteners to affix the base to the chair's support structure. Optionally the base could be mounted atop a pre-existing buttocks seat. The seating apparatus of this invention could also be affixed to other types of chairs, all that is needed is a supporting frame or surface for affixing the base 14 to the supporting chair. Likewise, armrests and back rests which are part of a chair support to which the base is affixed would work satisfactorily with the seating apparatus 2.

A socket block 18 defines a cylindrical socket hole 20, open to the top surface of the block. The bottom of the socket hole is hemispherical. A pivot post 22 has a ball 24 which is spherical and defines a threaded hole into which a threaded post 26 is threadingly and preferably adhesively affixed. The ball is preferably stainless steel which will provide a durable surface that will not rust. The socket hole 20 has a diameter equal to or just slightly greater than the ball's diameter. The socket block is a rigid material, preferably nylon, which will maintain adjoining surfaces with the ball without seizing, without rusting, and without the need for lubrication. The ball 24 is disposed in the socket hole 20 abutting the bottom hemispherical surface of the hole. A retainer washer 28 having an outside diameter which is the equal to or slightly less than that of the socket hole 20 is pressed into the hole with the threaded post 26 extending through a clearance hole 30 defined by the retainer washer. The socket hole 20 is just deep enough to receive the ball 24 and the retainer washer 28, preferably allowing the retainer washer to abut the ball's surface while its upper surface is flush with the upper surface of the socket block 18. This allows the pivot post 22 to rotate and pivot with respect to the socket block 18 with the retainer washer preventing the ball from moving vertically. The retainer washer 28 could as well be slightly thicker and have a concave spherically shaped bottom surface. The spherical surface having the same diameter as the ball 24. This would provide even more stability for the pivot post 22, but the flat retainer washer described also works satisfactorily. The washer 28 is preferably brass to prevent any rusting and to reduce the chance of the washer and ball seizing together.

The socket block 18 with the pivot post 22 and retainer washer 28 installed in the socket hole 20, is affixed to the base 14 by a large washer 32, and fasteners, such as bolts 34 and nuts 36. The large washer defines a clearance hole 38, through which the threaded post 26 is disposed. The clearance hole is preferably larger than the clearance hole 30 to allow the pivot post to rotate and pivot freely within a conical range, limited by the inner diameter 30 of the retainer washer and the inner diameter 38 of the large washer. The diameter of the clearance hole 38 is less than the outside diameter of the retainer washer 28 in order to maintain the retainer washer in the socket hole 20. A resilient elastomeric collar 40, preferably in the shape of a thick-walled cylinder is disposed on the base 14, surrounding the socket block 18. Preferably the collar's inside diameter is small enough to allow the collar to tightly fit around the socket block which will maintain the position of the collar on the base. The spring-like collar is preferably made of urethane, having a durometer hardness reading (Shore A scale) in the rage of from 50 A to 100 A. The collar of the preferred embodiment has a durometer hardness reading of approximately 70 A.

Continuing to refer to FIG. 1, A nut plate 42 defining a threaded through hole 44 is affixed to the bottom of a seat support 46, preferably by screws 48 through aligned holes defined in the seat support and nut plate therefor. When the nut plate is affixed to the seat support, the center of the threaded hole 44 is aligned with the center of a clearance hole 48 in the seat support which is defined generally in the center of the support. The seat support 46 is the same shape generally as the base 14 and is preferably constructed from steel and has edge flanges to help assure that it remains rigid during use. The bottom surface of the seat support rests on the top of the resilient elastomeric collar 40. The seat support has mounting brackets 50 affixed, preferably by welding, proximate the corners of the support. The buttocks seat 6 is affixed to the seat support 46 by means of fasteners 52. The seat support is threadingly affixed to the pivot post 22 by threading the end of the threaded post 26 through the threaded hole 44 until the end of the post is disposed through the clearance hole 48 and above the surface of the seat support. The adjustment wheel 54 is affixed to the end of the pivot post 22, preferably by a set screw 56 tightened against a flat 58 on the end of the post. The knob preferably has a plurality of spokes extending radially from the knob in a generally horizontal plane.

Figure 4:
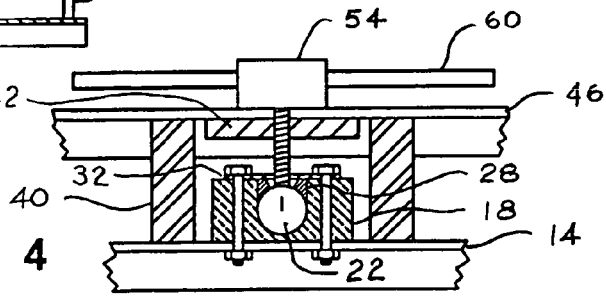
FIG. 4 is a cross-sectional view taken at line 4 in FIG. 2.

Referring to FIG. 4, which shows the above-described component parts assembled into the seating apparatus of the invention. The socket block 18 is affixed to the base 14 with pivot post 22 disposed in the socket hole 20 (FIG. 1) where it is pivotally captured by retainer washer 28 and large washer 32. The threaded post (FIG. 1) of the pivot post is threaded through the nut plate 42 which is affixed to the bottom of the seat support 46 which rests on the top of the resilient elastomeric collar 40. The adjustment wheel 54 is affixed to the end of the pivot post 22. The wheel can be turned by use of the spokes 60. Rotating the wheel rotates the pivot post 22, the ball 24 of which rotates in the socket hole 20 of the socket block 18. As the pivot post is rotated it rotates in the threaded hole 44 of the nut plate, causing the nut plate, seat support and seat to be raised or lowered, with respect to the base 14, depending on the direction the adjustment wheel 54 is turned.

With the adjustment wheel 54 tightened, the bottom of the seat support 46 pushes down on the top of the resilient elastomeric collar 40, compressing it slightly. In this position, the apparatus would be stable and would tend to maintain a level position. A seated person 4 would have a to exert considerable force to cause the apparatus to appreciably tilt since the collar is in compression and would exert greater resistance to further compression. By loosening the adjustment knob 54, the compression of the collar 40 is reduced and the resistance to further compression is more easily overcome by a seated person trying to tilt the seat by a shift in the person's weight or by pivoting of the person's hips. With the adjustment knob loosened so the collar is not compressed beyond that applied by the weight of the seated person it would be easy for the person to cause the seat to tilt by a shift of the person's weight or by pivoting of the person's hips. The shift in weight would cause the collar 40 on the side of the weight shift to be compressed. The seat support 46 riding on the top of the collar would tilt as the collar compresses, with the pivot post 22 pivoting in the socket hole 20. The tilting is limited by the pivot post's conical range and also by stops 62 which are pins extending normally from the upper surface of the base 14 (FIGS. 2 and 3) on which the bottom surface of the seat support would abut. The stops are preferably threaded to allow adjustment for the amount of tilt, side to side, and front to back.

Referring to FIGS. 2 and 3, the elasticity of the collar 40 allows the buttocks seat 6 to be rotated about the two medians of the seat support 46 by selected movement of the person's lower body. In other words, the top plate has two degrees of selective movement, e.g. pitch and roll, so that it can be selectively tilted over a range of inclination angles and over 360 degrees of orientation.

When the person's weight is evenly distributed over the seat support and centered on the vertical axis 8, the seat support will be generally horizontal, and the person's spine 12 will be straight and aligned generally vertically when viewed from the rear. Normally, the base 14 will be supported by a horizontal foundation, in which case it will be in a horizontal plane.

The buttocks seat 6 would preferably have some cushioning (not shown) for comfort and a cover (not shown). Additionally, an extended cover or shroud (not shown) could be affixed around the seating apparatus to conceal the tilting mechanism between the buttocks seat and the base. Such a shroud would also assist in keeping the parts clean. Any such shroud would attach to the seat support 46, allowing easy access to the adjustment knob 54 so the seat can easily be adjusted.

Referring to FIG. 3, when the weight of the seated person 4 is shifted slightly from the axis 8, the seat reacts to the weight shift. First, there is a compression of one side of the collar 40 due to the increase in the distribution of weight on that side (the right side as shown). Second, the reduction in the weight distribution on the opposite side of the weight shift, together with the resistive force of the resilient collar tending to return to its uncompressed position causes the opposite side of the collar (the left side as shown) to expand.

This collar expansion on one side exaggerates the tilt of the seat support 46 downward on the side to which the weight has shifted. Third, the tilting of the seat support (and the pivot post 22) causes the centerline of the seat to shift slightly to the direction of the weight shift (to the right). This slight offset from the vertical axis 8 further exaggerates the leverage of the person's weight shift and adds additional force to compress the right side of the collar. Likewise, if the seated person's weight is shifted to the left of the vertical axis 8, the top plate will pivot on the collar and compress it on the side to which the weight has shifted (the left side) and thereby allow the opposite side of the collar (the right side) to expand and exert a resilient force upward. Again in this case the offset, due to the tilting from the vertical axis further compresses the collar on the side to which the weight has been shifted (the left side). This tilting reaction to a shifting in weight works the same way in the front to back direction, or in any direction.

Referring again to FIG. 3, the line 12 designating the spine of the seated person, is no longer aligned with the vertical axis 12, but is bowed convexly toward the side to which the person's weight has shifted. Bowing of the spine separates the transverse processes of the lumbar vertebrae on the side to which the person's weight has shifted. This separation stretches and lengthens the muscles attached to the processes. Repeated stretching and contracting of the muscles strengthens the lumbar region and prevents tearing of muscle fibers. Muscle tissue that has been damaged is shortened, weakened and scarred. Low back pain usually recurs on the same side and in the same place as the previous episode. The only way to prevent a recurrence is to lengthen and strengthen that damaged muscle and repair the scar tissue by repeated stretching exercise. This seating apparatus provides constant repetitive stretching exercise for all the muscles in the lumbar cage including any that have been shortened and scarred. The muscles in the lumbar cage also connect with those in the pelvis. In the tilted position shown, the pelvis is also tilted in relation to the spine, with its right side lower than the left side, requiring the contraction of muscles on one side (the left side) and relaxation of muscles on the other side. If the person's weight is shifted to the opposite side (toward the left), beyond the vertical axis 8, the seat support 46 will pivot on the collar 40 compressing the collar on the side to which the weight has shifted (the left side), allowing the collar to expand on its opposite side (the right side). The line 12 designating the person's spine will then be bowed convexly to the left (not shown) and the pelvis will be tilted so it is lower on the left side than on the right (not shown).

To accomplish such shifts in the person's weight requires the complex and coordinated control of the muscles in the lumbar cage, pelvic region and the upper body. These muscles work together to shift the person's weight from one side to the other by rocking the pelvis from the one side to the other side. This is done by: bending the spine to cause a slight leaning of the upper body to the side of the weight shift; straightening of the spine in the lumbar region; and then bending it in the opposite direction to accomplish the weight shift. In doing this, the muscles work together, some contracting and some relaxing, to maintain the person's control and balance. While the person's weight is being shifted from side to side, the shape of person's spine is being changed from being bowed to one side to being bowed to the opposite side. While the decision to shift weight is a conscious decision, the control and contraction of the individual muscles is primarily performed sub-consciously by the person's balance control. In performing such weight shifts, the muscles in the lumbar cage, including those interconnecting with the pelvis and upper body, are worked and exercised.

Since the seating apparatus can be used by a person while seated at work, it provides a means for the person to exercise the muscles in the lumbar cage while working. This invention allows lumbar exercise to be done on a continuing basis by using only normal or unobtrusive weight shifts, and with each weight shift the muscles are worked and exercised, keeping them active, flexible, and promoting their healthy tone and improving their strength. Formerly, sedentary jobs which required a person to sit at a desk, or in front of a computer monitor, meant long periods of inactivity for the lumbar cage, contributing to atrophy of the muscles and eventual lower back problems. With this invention, normal body movement during use will cause the lumbar cage muscles to be exercised. Thus, this invention provides effective back pain therapy during the very same type of sedentary tasks which would otherwise cause back pain in the first place, and continued use strengthens the lumbar cage.

While exercising the muscles of the lumbar cage to improve their strength and general health is of primary importance, muscles are controlled by nerves and the benefits of active, exercised muscles also affects the nervous system. In providing the signals which control the contractions of the lumbar cage muscles, the nervous system also benefits from the exercise provided by this invention. As with exercise of the muscles, use of the nervous system keeps the system healthy and prevents atrophy due to inactivity. The above-described exercise improves nervous system response time and muscle control. Likewise, use of the seating apparatus to exercise the lumbar cage muscles requires blood flow to the muscles, and adequate exchange of oxygen and carbon dioxide in capillaries to keep the muscles nourished and healthy while they are exercised. Thus, a person using the seating apparatus is also enhancing the vascular system's ability to supply blood and nutrients to the muscles, improving their ability to work. This increasing blood flow resulting from the increased muscle activity improves the health of the vascular system in the lumbar cage and its ability to supply blood to the muscles, thereby preventing their further atrophy.

Also, flexing the spine by use of the seating apparatus causes adjacent vertebrae to compress one side of the intervertebral discs, and then the other side, similar in fashion to the compression of the collar 40. This pumping action promotes the exchange of fluids into and out of the discs, thereby improving their ability to resist degeneration and maintain their healthy, hydrated flexibility.

Thus, use of the seating apparatus to exercise the lumbar cage not only exercises the muscles, improving their strength and ability to prevent lower back problems, but it also improves the nervous system, vascular system and the health of the intervertebral discs as well.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims.

I claim:

1. A lumbar flexing, buttocks seating apparatus comprising:

(a) a buttocks seat;

(b) a base;

(c) a block affixed to an upper face of the base;

(d) a ball socket defined by the block, the socket being open to a top of the block;

(e) a ball disposed in and confined to the socket;

(f) a threaded post projecting from the ball outwardly through the socket opening, the post being axially rotatable and tiltable about its ball over a range;

(g) a bracket threadably engaged on the post and affixed to the underside of the seat for supporting the seat on the post, the seat squarely facing upright when the post is vertical;

(h) a hand wheel affixed to the post for rotating the post relative to the bracket and the base to selectively raise or lower the seat relative to the base; and (i) a resilient bias for urging the post to be vertical unless a seated user flexes his or her lumbar with sufficient force to overcome the bias.

2. The apparatus according to claim 1 further comprising a plate affixed to the top of the block to confine the ball to its socket, the plate defining a hole through which the post loosely extends.

3. The apparatus according to claim 1 wherein the post is axially rotatable and tiltable about its ball over a conical range.

4. The apparatus according to claim 1 wherein the bias comprises a resiliently compressible, cylindrical ring concentric with the post, and extending between and abutting the base and the seat bracket.

5. The apparatus according to claim 3 wherein the bias comprises a resiliently compressible, cylindrical ring concentric with the post, and extending between and abutting the base and the seat bracket.

6. A lumbar flexing, buttocks seating apparatus comprising:

(a) a buttocks seat;

(b) a base;

(c) a threaded post tiltably affixed at one end to an upper face of the base, the post being axially rotatable relative to the base, the post being threadably engaged with an underside of the seat for supporting the seat on the post, the seat squarely facing upright when the post is vertical;

(d) a hand wheel affixed to the post for rotating the post relative to the seat and the base for selectively raising or lowering the seat relative to the base; and (e) a resilient bias for urging the post to be vertical unless a seated user flexes his or her lumbar with sufficient force to overcome the bias.

7. The apparatus according to claim 6 wherein the post is axially rotatable and tiltable over a conical range.

8. The apparatus according to claim 6 wherein the bias comprises a resiliently compressible, cylindrical ring coaxial with the post, and extending between and abutting the base and the underside of the seat.

9. The apparatus according to claim 7 wherein the bias comprises a resiliently compressible, cylindrical ring coaxial with the post, and extending between and abutting the base and the underside of the seat.

* * * * *